US009041529B2

(12) United States Patent
Booij et al.

(10) Patent No.: US 9,041,529 B2
(45) Date of Patent: May 26, 2015

(54) IDENTIFICATION DEVICES

(75) Inventors: Wilfred Edwin Booij, Nordby (NO); Arne Øyen, Asker (NO)

(73) Assignee: Sonitor Technologies AS, Oslo (NO)

( * ) Notice: Subject to any disclaimer, the term of this patent is extended or adjusted under 35 U.S.C. 154(b) by 798 days.

(21) Appl. No.: 12/740,285

(22) PCT Filed: Oct. 28, 2008

(86) PCT No.: PCT/GB2008/003658

§ 371 (c)(1),
(2), (4) Date: Oct. 7, 2010

(87) PCT Pub. No.: WO2009/056823

PCT Pub. Date: May 7, 2009

(65) Prior Publication Data

US 2011/0018710 A1 Jan. 27, 2011

(30) Foreign Application Priority Data

Oct. 29, 2007 (GB) ..... 0721162.6

(51) Int. Cl.
*G08B 1/08* (2006.01)
*G09F 3/00* (2006.01)

(52) U.S. Cl.
CPC ..... *G09F 3/005* (2013.01)

(58) Field of Classification Search
USPC ..... 340/286.07, 539.13, 572.1, 539.12, 340/539.11, 539.15, 573.1
See application file for complete search history.

(56) References Cited

U.S. PATENT DOCUMENTS

| | | | | |
|---|---|---|---|---|
| 3,696,384 | A * | 10/1972 | Lester | 367/199 |
| 4,872,148 | A | 10/1989 | Kirby et al. | |
| 4,955,000 | A * | 9/1990 | Nastrom | 367/117 |
| 5,621,384 | A * | 4/1997 | Crimmins et al. | 340/539.3 |
| 5,883,576 | A | 3/1999 | De la Huerga | |
| 5,933,330 | A | 8/1999 | Beutler et al. | |
| 6,273,339 | B1 | 8/2001 | Tuttle et al. | |
| 6,360,417 | B1 | 3/2002 | Jack et al. | |
| 7,551,894 | B2 * | 6/2009 | Gerber et al. | 455/41.2 |
| 2002/0084904 | A1 * | 7/2002 | De La Huerga | 340/573.1 |
| 2003/0052692 | A1 * | 3/2003 | Lin | 324/464 |
| 2005/0128099 | A1 | 6/2005 | Drouin et al. | |
| 2006/0101129 | A1 * | 5/2006 | Rubertelli et al. | 709/217 |
| 2006/0181421 | A1 * | 8/2006 | Forcier et al. | 340/572.1 |
| 2006/0187065 | A1 * | 8/2006 | Girvin et al. | 340/572.9 |
| 2006/0255947 | A1 | 11/2006 | Redler et al. | |
| 2009/0243833 | A1 * | 10/2009 | Huang et al. | 340/505 |
| 2010/0012733 | A1 * | 1/2010 | Lerch et al. | 235/492 |
| 2010/0214100 | A1 * | 8/2010 | Page | 340/572.1 |

FOREIGN PATENT DOCUMENTS

| | | |
|---|---|---|
| FR | 2799864 | 4/2001 |
| JP | 2003070852 | 3/2003 |
| WO | 9405090 | 3/1994 |
| WO | 0199088 | 12/2001 |

* cited by examiner

*Primary Examiner* — Brent Swarthout
(74) *Attorney, Agent, or Firm* — O'Shea Getz P.C.

(57) ABSTRACT

An identification device comprising an ultrasound transmitter unit (16) and an outer housing (6) which receives said transmitter unit (16), said outer housing (6) comprising one or more apertures (32) which are sealed by a membrane, said membrane being substantially transparent to ultrasound when compared to the rest of the housing.

15 Claims, 6 Drawing Sheets

IDENTIFICATION DEVICES

This application is entitled to the benefit of, and incorporates by reference essential subject matter disclosed in PCT Application No. PCT/GB2008/003658 filed on Oct. 28, 2008, which claims priority to Great Britain Patent Application No. 0721162.6 filed Oct. 29, 2007.

BACKGROUND OF THE INVENTION

1. Technical Field

This invention relates to identification devices which can be fitted to a person, animal or object to permit identification and/or real-time location tracking of the same.

2. Background Information

There is an important need in hospitals to be able to positively identify patients of the hospital to ensure that confidentiality is maintained and that the correct treatment is given. Conventionally this is achieved using single-use wrist bands on which identifying text, or occasionally a bar code, may be written or printed.

There is a separate problem in many hospitals that the efficiency of staff and some common resources such as surgical theatres and emergency departments can be reduced if patients cannot be located at the appropriate time thus requiring staff to go looking for them and holding up other patients awaiting attention or therapy, or otherwise impeding an optimal workflow. There are also other patients for which there is a need to locate them for security reasons, for example if they should leave a ward unexpectedly such as new-born babies and elderly patients suffering from dementia.

SUMMARY OF THE INVENTION

The Applicant has realized that the problems of identification and tracking can be addressed simultaneously by using ultrasonic identification. Thus, patients can be given individual active ultrasonic transmitters which can be used both for identification and tracking purposes. In particular, the applicant has devised such an identification device which is particularly suited to use in hospitals.

When viewed from a first aspect the invention provides an identification device comprising an ultrasound transmitter unit and an outer housing which receives said transmitter unit, said outer housing comprising one or more apertures which are sealed by a membrane, said membrane being substantially transparent to ultrasound when compared to the rest of the housing.

Thus it will be seen by those skilled in the art that in accordance with the invention an active ultrasound transmitter, which will typically be of relatively high value, can be accommodated in an outer housing which can protect it from contamination by dirt, fluid and infection agents whilst still allowing ultrasound signals to pass from the transmitter. If contamination of the main transmitter unit can be prevented, it is then easy for it to be re-used without requiring sterilization which would be difficult to achieve in view of the sensitive electronics and transducers associated with it. The outer housing could be cleaned and sterilized between each use (as it does not contain the sensitive electronics), but preferably it is disposable. It can be seen therefore that the benefits afforded by an ultrasonic identification and tracking system can be enjoyed whilst minimizing the cost thereof allowing reuse of the transmitter units by utilizing a relatively inexpensive disposable part which obviates the need for cleaning/sterilization and minimizes the risk of cross infection.

Although not essential, the membrane will typically be much thinner than the rest of the housing and/or of a different material. It is not necessarily essential that the membrane provides a hermetic seal. For example it is envisaged that it would be possible for it to comprise a sufficiently fine foam or mesh. However, in preferred embodiments a liquid-tight seal across at least the aperture(s) is provided. In preferred embodiments the membrane comprises a polymer film such as PVC, polyurethane or polyethylene. Preferably the film has a thickness of less than 50 μm, more preferably less than 20 μm and most preferably of the order of 10 μm. Such films (commonly known as cling film) are commonly and inexpensively available as they are used for wrapping and packaging food and other items.

The membrane preferably attenuates ultrasound at 40 kHz by less than 6 decibels (dB), preferably less than 3 dB.

In one of the important applications of the invention envisaged, the identification device will typically be fitted to a patient. The device could be worn around the neck, on clothing etc. Preferred embodiments however incorporate means for attaching the device to the body of a person. This could, for example, comprise an integral wrist or ankle strap. Equally however, in one set of preferred embodiments, the device comprises means for attaching it to an existing wrist strap. This is attractive since it means that conventional wrist straps can continue to be used to give a familiar visual identification, but since such straps are not easily removable and the preferred identification device is not easily removable from the strap, it is easy to ensure that patients keep their identification devices on. The strap, whether integral or separate, preferably comprises a one-way catch, as is well known for conventional hospital wrist bands, which allows the strap to be snapped closed but which cannot be re-opened without irreparably breaking the catch or cutting the strap which requires either a tool or very high degree of force. Similarly where the outer housing is adapted to be attached to a separate wrist band or the like, this attachment is also preferably configured so as to be single-use so that the device cannot be easily removed and cannot be re-used (thereby carrying a risk of cross-infection).

Such an arrangement as is described above is considered to be novel and inventive in its own right and thus when viewed from a further aspect the invention provides an identification device comprising a transmitter unit received in an outer housing, the outer housing comprising a single-use attachment means for attaching the device to a wrist strap. Where the outer housing has means for attaching to a separate wrist strap in accordance with any aspect of the invention this is preferably configured to allow attachment when the strap is being worn by a patient. In some preferred examples of this the attachment means comprises a flap adapted to slide between the strap and the patient in order to clamp the strap between said flap and the body of the outer housing.

The outer housing is preferably configured so that the transmitter unit can be sealed into it before attachment to a patient or patient's strap. This minimizes the risk of contamination entering the interior of the housing. The housing is preferably closed by a single-use catch which, once broken to allow release, cannot be re-used. Such an arrangement makes the device difficult to remove without special tools and also prevents inadvertent or deliberate re-use of potentially contaminated outer housings.

Whilst there is clearly an important application of the principles of the invention to identifying and tracking patients in the hospital, the invention is not limited to this application and indeed it is envisaged that there are many other applications which would benefit from the identification devices as described above. For example, they could be used with humans in other situations—e.g. prisons, or with livestock or other animals in farms, zoos, veterinary practices or the like. Furthermore, the applicant has appreciated that similar considerations to those described above in the context of hospital patients, apply to hospital equipment, hospital staff members and hospital visitors; and it is also envisaged that such identification devices can therefore be used with these.

The power source to the transmitter unit could be provided internally within the transmitter unit or, conceivably, externally of the whole device. However, the applicant has appreciated that in a particularly beneficial set of embodiments, a battery is provided within the outer housing such that it can be connected to the transmitter unit when the latter is inserted in the housing. This is beneficial since it means that the battery can be discarded along with the outer housing when each patient has finished using the device, thus ensuring that a fresh battery is available for each new patient. It also means that the transmitter unit itself does not need its own, longer life battery which saves on costs.

The battery may be integral to the outer housing for simplicity, or it could be removable for recharging/recycling. Preferably the battery is so arranged within the outer housing that connection between it and the transmitter unit is made automatically upon installation of the latter.

The arrangements set out above are considered to be novel and inventive in their own right and thus when viewed from a further aspect the invention provides a portable identification device comprising a transmitter unit and a battery for the transmitter unit which are received separately in an outer housing so that the transmitter unit can be removed from or installed into the outer housing independently of the battery.

The transmitter unit is preferably an ultrasonic transmitter unit and the outer housing preferably has the aperture and membrane specified in accordance with the first aspect of the invention. The preferred features of the first aspect of the invention are, where appropriate, also preferred features of the above aspect of the invention.

In accordance with each of the foregoing aspects of the invention it is preferred that the transmitter unit also comprises means for receiving a signal. This could be an ultrasound, radio frequency or infrared signal for example and is not limited to the type of signal which the transmitter transmits. However, in the presently preferred embodiments of the invention, the receiving means is an ultrasonic receiving means.

It is recognized that, depending on how identification devices as described above are used in practice, a device could be powered for a significant period of time whilst it is in stock waiting to be used. One solution to this might be not to assemble either transmitter units or batteries into the device until it is ready to be used, but this may not be practical. Alternatively therefore in at least some preferred embodiments the identification device is configured so as to enable it to be activated when it is required for use. This could consist simply of an on/off switch, although this is not preferred since it is not considered desirable to allow patients or other users to be able to switch the devices off. Various arrangements are envisaged whereby a mechanical single-use on switch could be provided, for example by providing a removable insulating tab in the electrical path between the battery and the transmitter unit, or by a part that can be broken off/deformed to allow electrical contact to be made. However, these options are presently unattractive for various reasons such as potentially compromising the barrier provided by the outer housing and/or adding to the cost of the device, particularly the outer housing.

In preferred embodiments of the invention the transmitter unit is adapted so that it can be activated upon receipt of a suitable signal, preferably an ultrasonic signal. Preferably the transmitter unit is configured to have at least two modes: a sleep or standby mode, in which it is simply receptive to the aforementioned signal; and an active mode into which the transmitter unit is switched upon receipt of the activation signal and in which the transmitter unit can or does transmit signals. In such an arrangement the sleep mode can be, and is preferably, configured so that there is very low power consumption compared to the active mode. This allows battery life to be extended whilst the device is not being used.

The activating signal could be any chosen signal although in accordance with preferred embodiments the signal is at a significantly higher power than other signals received by the device or signals transmitted by the device. This is easily achievable since such a signal will only be required relatively infrequently and can be transmitted from a transmitter placed in very close proximity to the identification device. The device might, for example, be placed in a docking station or a handheld transmitter could be placed next to or on top of the device. Another advantage of utilizing a very strong activation signal is that the requirement for amplification and/or processing of the signal is reduced which reduces the power requirement for the sleep state.

In preferred embodiments of the invention the transmitter unit can receive configuration information encoded on a suitable wireless signal. Again, it is preferred that this is an ultrasound signal. This configuration information could be received as part of the activation signal, although it is preferred that it is separate for the reasons given above. The configuration information would typically include the identification information which the transmitter unit is to give once in use for a particular patient. It might also include, for example, status codes associated with that patient associated with either the identification or tracking function of the device. For example, an identification device being configured for a new-born baby or an elderly patient might contain a flag to generate an alarm if the device is taken outside a pre-designated ward. As well as or instead of configuration information, the transmitter unit might receive other data such as new or updated software.

Similarly the transmitter unit can, in some embodiments, transmit as well as receive information during a configuration or commissioning process. It might for example transmit identity information such as a serial number.

BRIEF DESCRIPTION OF THE DRAWINGS

A preferred embodiment of the present invention will now be described, by way of example only, with reference to the accompanying drawings in which.

DETAILED DESCRIPTION OF THE INVENTION

Figure 1:
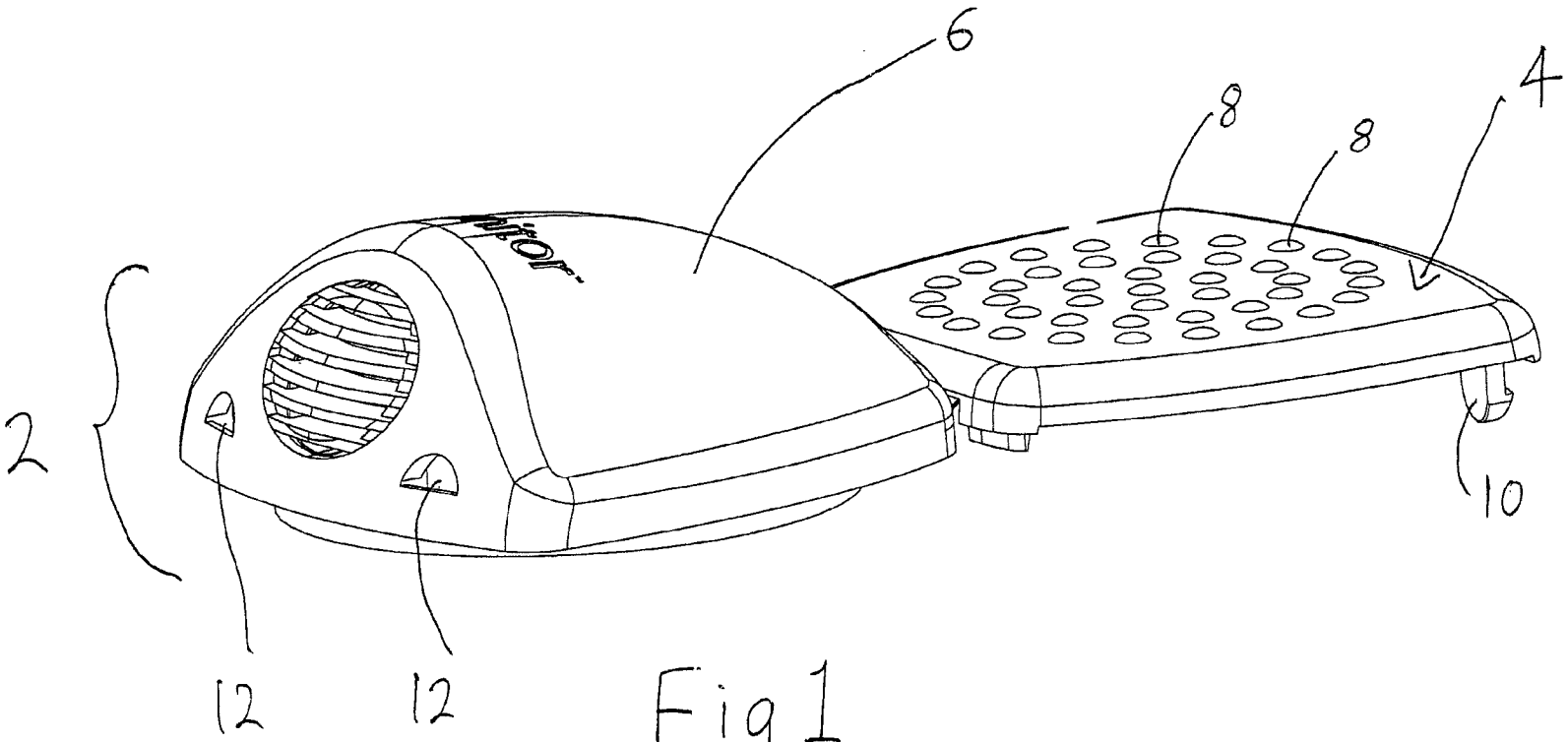
FIG. 1 is a view of an identification tag embodying the invention prior to its attachment to a patient wrist strap.

FIG. 1 shows an ultrasonic identification tag for identifying, and/or tracking the movements of, a patient in a hospital. The embodiment described herein has been developed so as to be particularly suitable for this application, although the skilled person will appreciate that the principles embodied may find useful application in a wide variety of uses.

The tag comprises two main parts which are a main body portion 2 and a hinged flap portion 4. The flap portion 4 is molded integrally with the upper body shell 6 to faun a so-called living hinge (not shown). On the upper face (as seen in FIG. 1) of the flap portion 4 are formed a series of rounded protrusions 8. This will be the part of the tag which presses against the patient's skin, and the protrusions 8 help to prevent the tag from slipping and make the tag more comfortable for the patient to wear for a prolonged period of time without causing skin irritations or reactions. The material of the outer shell is biodegradable or recyclable and is non-abrasive against skin.

At the distal edge of the flap portion 4 is a pair of integrally molded, downwardly extending hooks 10 (one of which can be seen in FIG. 1), which are positioned so as to engage in corresponding half-moon apertures 12 formed in the front face of the upper body shell 6 when the flap portion 4 is closed around under the bottom of the main body portion 2. This can be seen in FIG. 2. As the flap portion 4 is closed, a wrist strap 14 can be sandwiched between the bottom of the main body portion 2 and the flap portion 4. The hooks 10 engage in the apertures 12 in the upper body shell 6, thereby firmly securing the tag to the wrist strap 14. The hooks 10 are very stiff and make a tight fit in the apertures 12 such that the hooks 10 cannot easily be removed without use of a special tool.

Figure 3A:
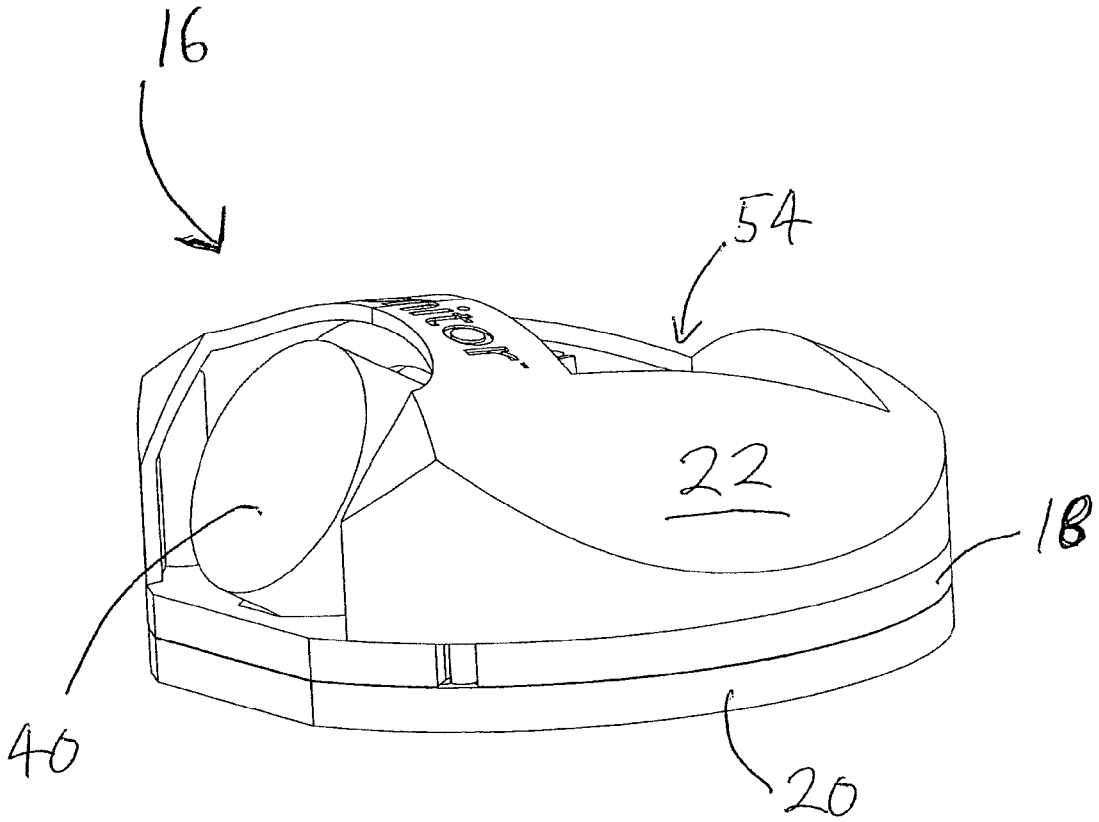
FIG. 3 is an exploded view from above of the internal structure of the tag body.
Figure 3B:
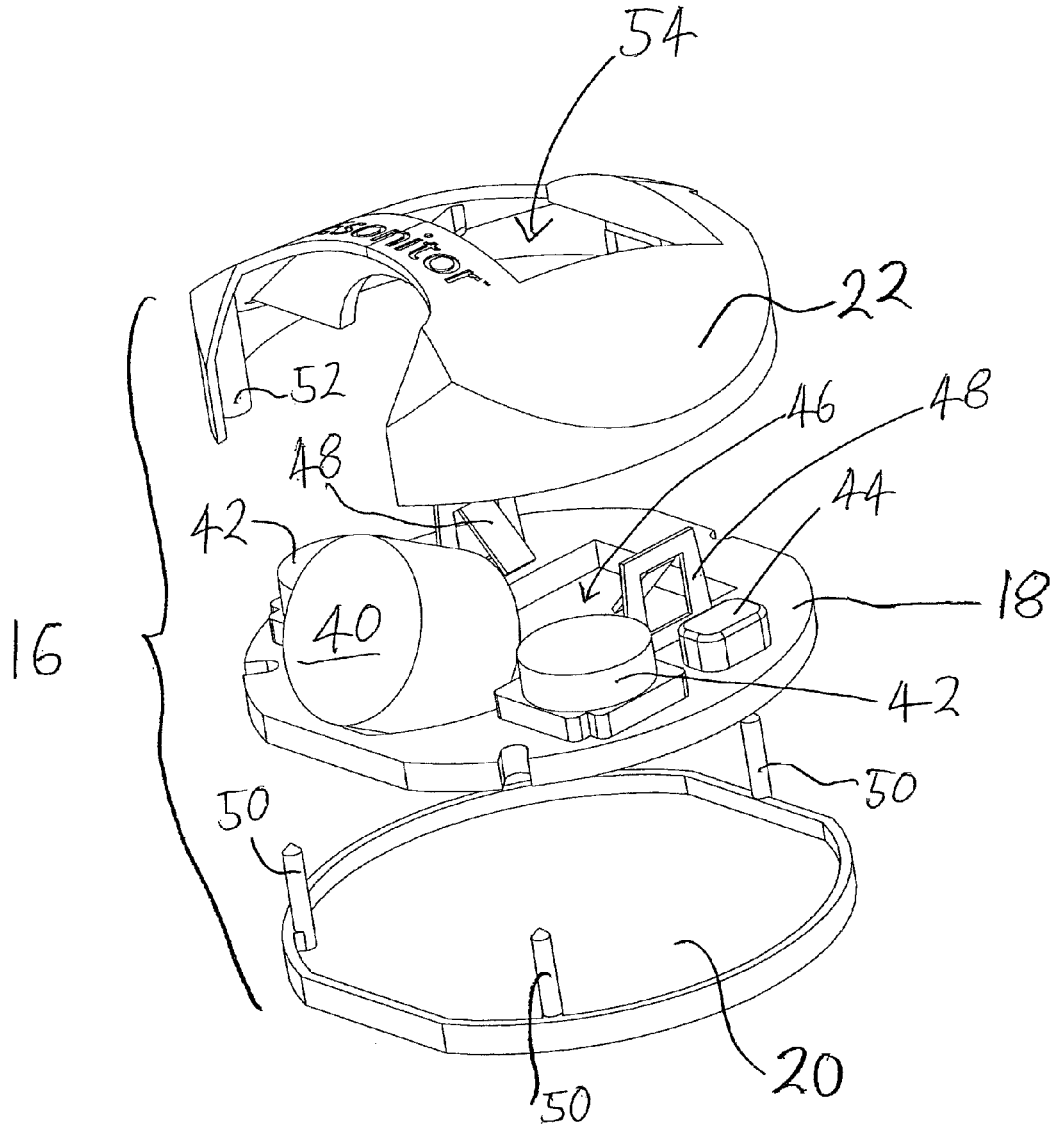
Figure 4:
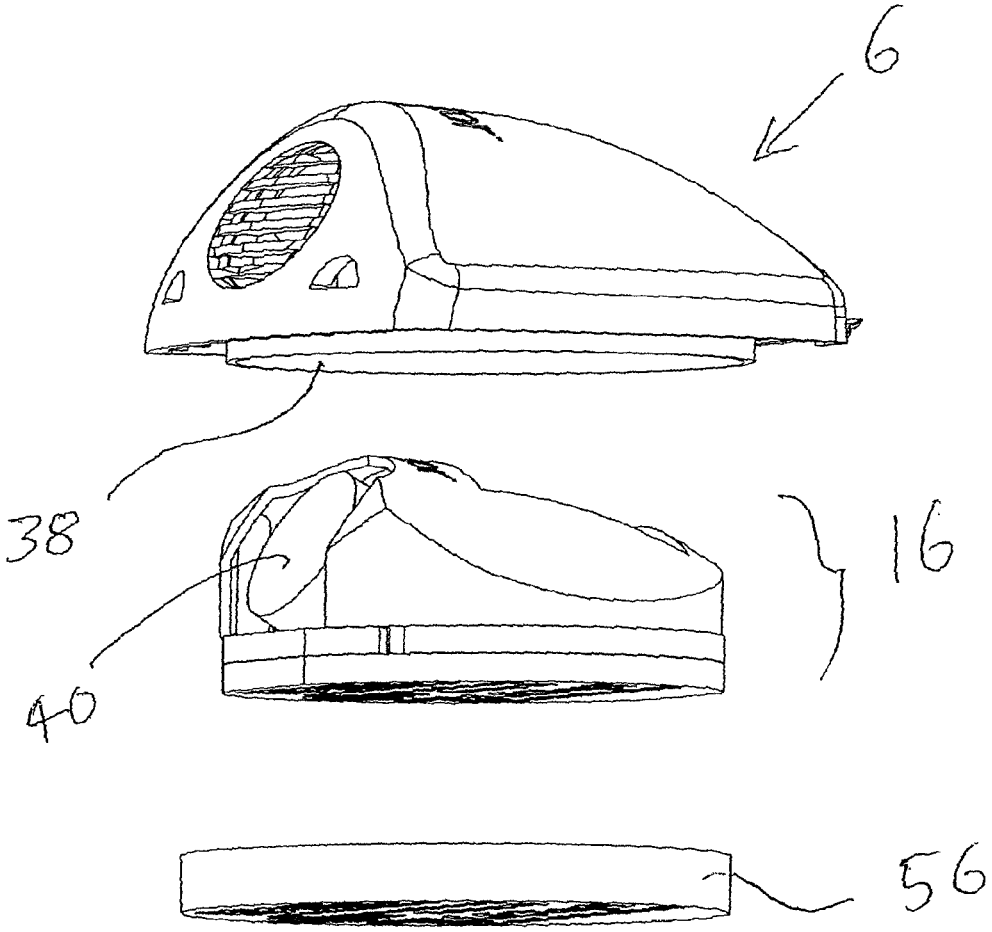
FIG. 4 is an exploded view from below.
Figure 5:
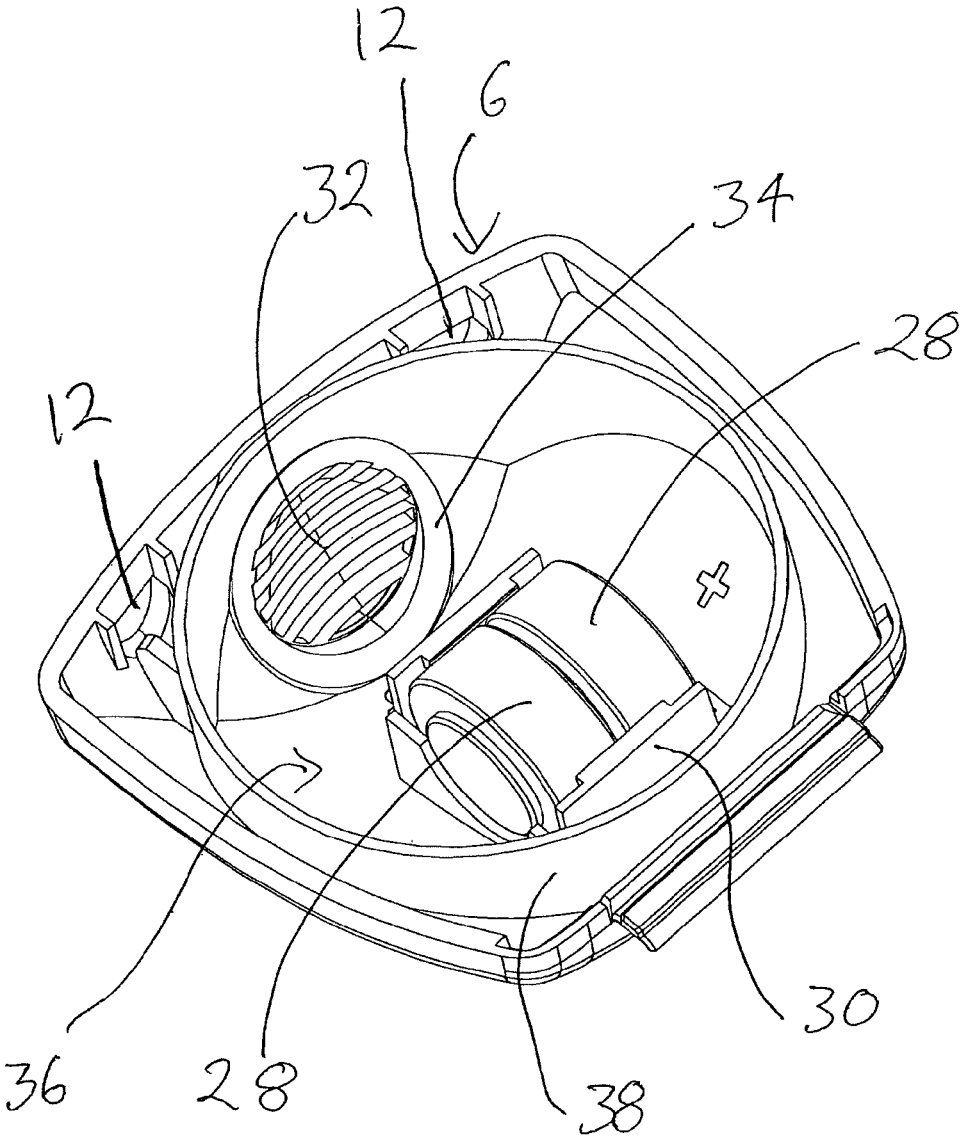
FIG. 5 is a view from beneath of the tag upper body shell.

FIGS. 3*a*, 3*b*, 4 and 5 show exploded views of the main body portion 2 of the tag. In FIGS. 3*a*, 3*b* and 4, the flap portion 4 of the tag has been omitted for clarity. At the heart of the main body portion 2 is a tag kernel 16 shown in FIG. 3*a* and in exploded view in FIG. 3*b*). The tag kernel 16 has inside it a printed circuit board 18 which carries the components for an ultrasound transmitter unit. These components include an ultrasound transducer 40, a pair of inductors 42 and a crystal 44. It may also be seen that there is an approximately square aperture 46 on two sides of which lie a pair of resilient electrical contact tabs 48. These tabs 48 make contact with batteries when the tag is assembled, as will be described later.

The tag kernel 16 is completed by a lower kernel molding 20 and an upper kernel molding 22. The lower kernel molding 20 carries three vertically projecting pins 50 which engage in corresponding cylindrical bosses 52 in the upper kernel molding 22 (only one of which is visible in FIG. 3*b*). This allows the circuit board 18 to be sandwiched between the upper and lower kernel moldings 20, 22. The upper kernel molding 22 is shaped at the front to frame the ultrasound transducer 40 as can be seen in FIG. 3*a*; and is provided with an aperture 54 at the top in alignment with the aperture 46 in the circuit board 18.

The vertical pins 50 and bosses 52 are configured so that they form a tight interference fit when the tag kernel 16 is assembled at the factory such that it is difficult or impossible to dismantle remove manually. Glue can be used as well or instead. This creates a robust, self-contained unit 16.

As will be appreciated from the foregoing, the tag kernel 16 cannot itself operate as an ultrasound transmitter or receiver as it does not have any batteries. These are inserted automatically when the complete tag is assembled by placing the tag kernel 16 into the upper body shell 6 as shown in FIG. 4. As the tag kernel 16 is pressed up into the upper body shell 6, the two contact tabs 48 on the circuit board 18 (see FIG. 3*b*) inside the tag kernel 16 engage the positive and negative sides respectively of a pair of button cell batteries 28 which are held in a plastic retaining clip molding 30 on the inside of the upper body shell 6. This can be seen in FIG. 5. Thus, as the tag kernel 16 is inserted into the upper body shell 6 from beneath, the batteries 28 partly protrude through the apertures 54, 46 (see FIG. 3*b*) in the upper kernel molding 22 and circuit board 18 respectively, and the two contact tabs 48 make electrical connection with them in order to power the circuit. When power is applied to the circuit in this way, it enters a sleep mode which has a very low quiescent current of the order of 1 μA. In this mode the transmitter unit simply awaits an activation signal.

It will also be seen that as the tag kernel 16 is pressed into the upper body shell 6, the ultrasonic transducer 40 will be positioned directly behind a grille 32 formed on the front face of the upper body shell 6. The inwardly facing side of the grille 32 is visible in FIG. 5. Although omitted for clarity, in practice there is an impermeable membrane comprising a thin PVC film (approx. 10 microns) stretched across the bezel 34 around the rear face of the grille 32 to provide a hermetic seal.

The bezel 34 and battery clips 30 are both molded as part of the upper body shell 6 in an inner portion 36 defined by an annular vertically protruding wall 38 the purpose of which will be described below.

Returning to FIG. 4, it can be seen that when the tag kernel 16 has been placed inside the upper body shell 6, it is held in place by a sealing cap 56. The diameter of the cap 56 is designed so that it is a tight fit around the outer circumference of the annular wall 38 on the inside portion 36 of the upper body shell 6. It will be appreciated that by virtue of this arrangement, the active components such as the transducer 40 etc. are retained within a sealed compartment formed inside the tag. The tag is then in the state shown in FIG. 1—i.e. ready to be clamped onto a wrist band for use.

Figure 2:
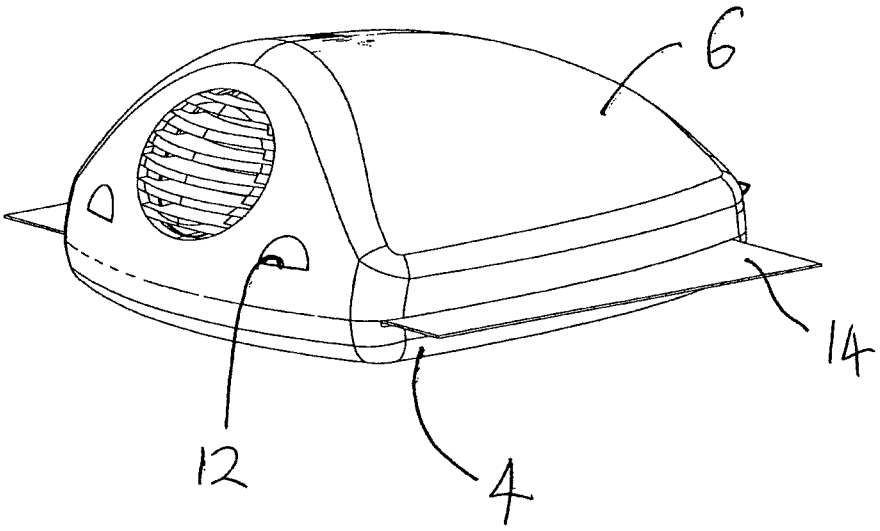
FIG. 2 is a view of the tag attached to a wrist strap.

As previously described, when the tag is needed the main body portion 2 can be placed on top of a patient wrist strap 14 as is shown in FIG. 2. The flap portion 4 is then folded over underneath the strap 14 and clipped onto the bottom of the main body portion 2 so as to trap the strap 14 between them. This permanently attaches the identification tag to the strap 14. The strap 14 can now be attached to a patient in a known manner. If the patient is already wearing the strap 14, the tag is attached by first sliding the flap portion 4 underneath the strap 14 and then folding the main body portion 2 down onto it.

Either before or after it is fitted to the patient the transmitter unit is placed into an active ("wake up") state by applying a very short-range, high-energy burst of ultrasound which is detected by the transducer 40. After wake-up there is the possibility of two-way ultrasound communication. This ultrasound communication can for example include: software download or configuration settings to the tag; and/or read-back of serial number, unique identification, software version or configuration information to the tag. These signals may be provided/received by a docking station, base station or hand-held transceiver, for example.

After wake-up and configuration, the tag then transmits its identification information at periodic intervals and/or when interrogated by a base station until the tag is no longer required for that patient—e.g. until the patient is discharged—or until the battery is exhausted. The battery is designed to last approximately thirty days. The tag is preferably arranged to transmit a low battery message as it nears the end of the life of the battery so that a fresh tag can be configured for the patient if one is still required.

When a tag is no longer required for a particular patient the wrist strap 14 is cut to release it from the patient's wrist or the single-use catch is broken. The tag can-not therefore be fitted to another patient. The main body portion 2 is then removed from the strap 14, again by forcibly prying the flap portion 4 away from the main body 2 using a suitable tool. This inevitably damages the connection between the flap portion 4 and the upper body shell 6 (for example by snapping the hook clips 10) so that they cannot be fitted back together. Finally the sealing cover 56 is removed which allows the tag kernel 16 to be removed. Removal of the tag kernel 16 automatically disconnects it from the batteries 28 which remain in the clips 30 in the upper body shell 6. The transmitter unit then loses its configuration information and will automatically return to sleep mode when it is next powered. It is therefore ready simply to be used again. Optionally but preferably an ultrasound receiver may be used in the vicinity of an area where tags are decommissioned. This can be used to detect the sudden cessation of transmission from a particular tag as it's tag kernel 16 is removed from its battery and interpret this as a special event signifying that a tag is no longer being used. This can be communicated to a central database to allow immediate reallocation of resources (e.g. a bed) to a new patient.

Since the transmitter unit has been protected in a sealed environment inside the tag (formed between the sealing cap 56, the annular wall 38 and the film across the grille 32 and will be so again when it is next used, there is no need to clean or sterilize it before its next use. However if desired as a precaution, it can be treated by a plasma or radical-based process for example. This might be ordered for example only if it was noticed during decommissioning that the membrane had been ruptured or if decommissioning was carried out carelessly such that the transmitter unit was allowed to contact the exterior of the outer housing of the tag. Otherwise the tag kernel 16 is placed in a separate receptacle for re-use.

The batteries are removed from the upper body shell 6 by snapping the frangible clips 30 and are placed in a second receptacle to be industrially recycled. The upper body shell, 6, strap 14 and sealing cap 56 are placed in a third receptacle and can also be sent for suitable material recycling if such is available which can cope with medically contaminated materials.

The decommissioning process set out above can easily be achieved by an automated tool which causes the appropriate parts to fall into separate gins (e.g. tag kernels 16, batteries and contaminated materials).

It will be apparent to those skilled in the art that the foregoing detailed description is merely one possible implementation and that there are many other possible implementations of the various principles set out herein. For example it is not essential that the transmitter unit is based on ultrasound, nor that it can receive as well as transmit. Other means of attachment to the target could be employed and the battery or other power source need not be separate to the transmitter unit.

What is claimed is:

1. A portable identification device comprising:

a disposable outer housing, with a battery retained in the outer housing; and a reusable transmitter unit, sealed entirely within the outer housing, and configured to transmit identification information at periodic intervals and/or when interrogated by a base station, wherein the transmitter unit comprises electrical contacts positioned so that an electrical connection between the battery and the transmitter unit is made automatically when the transmitter unit is inserted in the outer housing, and is broken automatically when the transmitter unit is removed from the outer housing, so that the transmitter unit can be installed into, and removed from, the outer housing independently of the battery.

2. The identification device of claim 1 wherein the transmitter unit is an ultrasonic transmitter unit.

3. The identification device of claim 1 wherein the outer housing comprises one or more apertures which are sealed by a membrane, said membrane being substantially transparent to ultrasound when compared to the rest of the housing.

4. The identification device of claim 1 comprising an integral wrist strap.

5. The identification device of claim 1 comprising an arrangement for attaching the device to a wrist strap.

6. The identification device of claim 5 wherein the attachment arrangement comprises a flap adapted to slide between the wrist strap and the patient in order to clamp the wrist strap between said flap and a body of the outer housing.

7. The identification device of claim 1 wherein the transmitter unit also comprises a receiver for receiving a signal.

8. The identification device of claim 7 wherein said receiver is an ultrasonic receiver.

9. The identification device of claim 1 wherein the outer housing is configured so that the transmitter unit can be sealed into the outer housing.

10. The identification device of claim 1 wherein the outer housing can be closed by a single-use catch which, once broken to allow release, cannot be re-used.

11. The identification device of claim 1 wherein the electrical contacts comprise a pair of resilient electrical contact tabs, arranged to engage positive and negative sides of the battery respectively as the transmitter unit is inserted into the outer housing.

12. The identification device of claim 1 wherein the outer housing comprises a clip for retaining the battery.

13. A method of manufacturing a portable identification device, the method comprising inserting and sealing a transmitter unit entirely within an outer housing, wherein a battery is retained in the outer housing before the transmitter unit is inserted in the outer housing, wherein the battery is not electrically connected to the transmitter unit before the transmitter unit is inserted in the outer housing, and wherein the transmitter unit comprises electrical contacts positioned so that an electrical connection between the battery and the transmitter unit is made automatically upon said insertion of the transmitter unit in the outer housing, the transmitter unit being configured to transmit identification information at periodic intervals and/or when interrogated by a base station.

14. The method of claim 13 comprising first removing the transmitter unit from another outer housing of another portable identification device, wherein the other outer housing has another battery retained therein.

15. The method of claim 14 further comprising disposing of the other outer housing and the other battery retained therein.

* * * * *